US005930914A

United States Patent [19]

Johansson et al.

[11] Patent Number: 5,930,914

[45] Date of Patent: Aug. 3, 1999

[54] METHOD AND DEVICE FOR DRYING A MOVING WEB MATERIAL

[75] Inventors: Leif Johansson, Vänersborg; Börje Alexandersson, Uddevalla, both of Sweden

[73] Assignee: Infrarödteknik AB, Vänersborg, Sweden

[21] Appl. No.: 08/981,363

[22] PCT Filed: Apr. 18, 1996

[86] PCT No.: PCT/IB96/00436

§ 371 Date: Jul. 13, 1998

§ 102(e) Date: Jul. 13, 1998

[87] PCT Pub. No.: WO97/39299

PCT Pub. Date: Oct. 23, 1997

[51] Int. Cl.[6] ..... F26B 3/34

[52] U.S. Cl. ..... 34/273

[58] Field of Search ..... 34/266, 267, 268, 34/269, 273, 524, 525, 526, 68; 219/388, 398; 392/411, 417, 422, 431, 432, 440; 162/206, 207, 375

[56] References Cited

U.S. PATENT DOCUMENTS 4,773,167 9/1988 Jacobi, Jr. ..... 34/277
4,882,852 11/1989 Kautto ..... 34/41
5,010,659 4/1991 Treleven ..... 34/269

FOREIGN PATENT DOCUMENTS 0288524 8/1991 European Pat. Off. .
4202944 8/1993 Germany .
8706636 11/1987 WIPO .

*Primary Examiner*—Henry Bennett
*Assistant Examiner*—Steve Gravini
*Attorney, Agent, or Firm*—Steinberg & Raskin, P.C.

[57] ABSTRACT

A method and device for drying a moving web including a first infrared radiator arranged on a first side of the web and a second infrared radiator arranged on a second side of the web at least partially opposite to the first infrared radiator and proximate to the first infrared radiator. The wavelength of the maximum intensity of the radiation generated by the first infrared radiator is shorter than the wavelength of the maximum intensity of the radiation generated by the second infrared radiator. The power density of the first infrared radiator is from about 450 kW per sq.m to about 700 kW per sq.m and the emitter temperature of the first infrared radiator is from about 2000° C. to about 2800° C. The second infrared radiator includes a surface layer made of a metal, metal alloy or ceramic material whose emissivity is substantially equal to or higher than about 0.6.

20 Claims, 5 Drawing Sheets

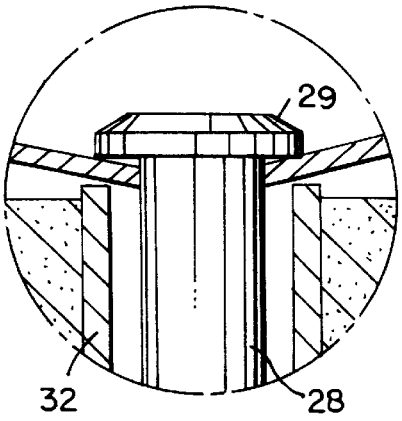
FIG. 9
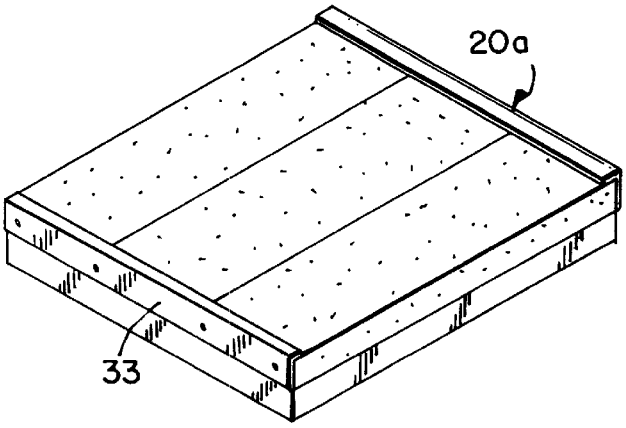
FIG. 10
FIG. 14
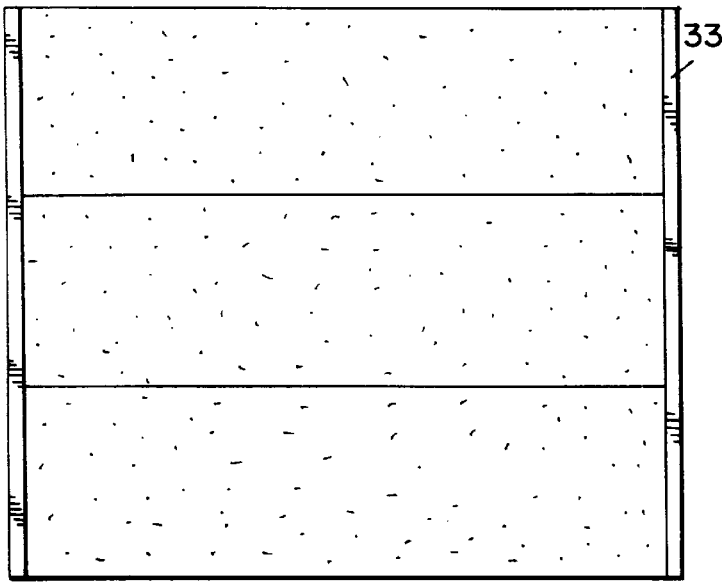
FIG. 11
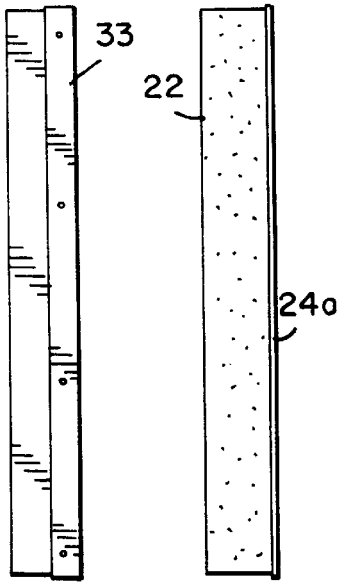
FIG. 13
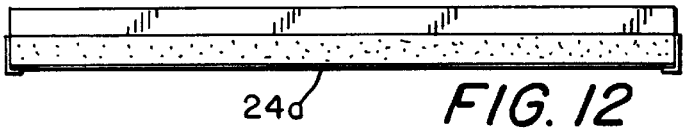
FIG. 12

METHOD AND DEVICE FOR DRYING A MOVING WEB MATERIAL

FIELD OF THE INVENTION

The invention concerns a method for drying a moving web material, in which method infrared radiation is directed at the material to be dried and in which method the moving web material is passed through the radiation one of an infrared radiator while the web material to be dried absorbs radiation into itself, in which method the radiation produced by at least one first infrared radiator and the radiation produced by at least one second infrared radiator are applied to the moving web material to be dried, said radiators being fitted in the vicinity of one another, and the wavelength of the maximum intensity of the radiation of said first infrared radiator being shorter than the wavelength of the maximum intensity of the radiation of said second infrared radiator, in which case, in the drying process, the spectrum of the overall radiation is optimal in view of the absorption spectrum of the material to be dried, and in which method the first infrared radiator is placed at one side of the web material and the second infrared radiator at the opposite side.

The invention also concerns a device for drying a moving web material, which device is fitted to direct infrared radiation at the moving web material to be dried, and which device comprises at least one first infrared radiator and at least one second infrared radiator, which are fitted at the vicinity of one another, and the wavelength of the maximum intensity of the radiation of the first infrared radiator being shorter than the wavelength of the maximum intensity of the radiation of said second radiator, and in which device the first infrared radiator is placed at one side of the web material and the second infrared radiator at the opposite side.

BACKGROUND OF THE INVENTION

In paper and textile industries and also in other fields of industry, a moving web material is dried. In the production and finishing of paper, there are a number of stages at which drying has to be carried out by means of a method not contacting the web, for example by drying by means of radiation.

The infrared radiator devices currently used for drying of a web material consist of high-temperature quartz-tube radiators or of gas-operated medium-wave radiators. The wavelength range of a high-temperature short-wave radiator is substantially 0.5 . . . 5.0 $\mu$m, while the peak is at about 1.2 $\mu$m. When a thin web is dried, the short-wave radiation penetrates through the web, because the absorption coefficient of the material is, as a rule, poor in the wavelength range between 0.5 $\mu$m and 2.0 $\mu$m, as the absorption peak is in a range substantially higher than 2 $\mu$m. Thus, the emission peak of the radiator and the absorption peak of the web material do not coincide. However, with a high-temperature short-wave radiator, a high power density per unit of area is achieved. The power density may be up to 450 kW per sq m, in which case the radiation energy absorbed into the web is higher than 130 kW per sq m. Power densities of said order are required in an attempt to obtain quick drying, which is again necessary, for example, in a process of coating of paper.

The wavelength range of medium-wave infrared radiators is substantially 1.5 $\mu$m . . . 6.0 $\mu$m. The wavelength corresponding to the maximum intensity is placed approximately between 2.0 $\mu$m and 3.0 $\mu$m. One of the points of absorption maximum of the water to be evaporated is situated within said interval. At said interval, the absorptivity of cellulosic fibres is also good. Out of the reasons mentioned above, the radiation efficiency of the radiation of a medium-wave radiator is high, about 40–60%, whereas the corresponding efficiency with short-wave infrared radiators, i.e. with a high-temperature radiator, is about 30–35% when drying of thin web materials is concerned. When the thickness of the material is increased, the efficiency of absorption becomes higher especially for the short-wave radiators.

The maximum power density attainable with medium-wave infrared radiators is 60 . . . 75 kW per sq m when a one-sided source of radiation is used, and 120 . . . 150 kW per sq m when a two-sided source of radiation is used.

A dryer composed of an infrared radiator device, i.e. an IR-dryer, consists of a radiation face, which is placed as close to the face to be dried as possible. In the prior-art devices, the radiation face is enclosed in a box, and the box is fixed in a suitable location on the frame constructions of the- process equipment either stationarily or as provided with a displacing mechanism. Further, in said dryers, the use of a backup reflector is known, which reflects the radiation that has passed through the material to be dried and thereby intensifies the process of drying.

From the prior art, a number of different IR-dryers used for drying of a moving web or web material are known. The operation of these dryers is based on the ability of pieces to emit electromagnetic radiation, which is specific of the temperature of the piece. It is a second feature characteristic of radiation that, instead of one wave-length, the radiator emits several wavelengths, whereby an emission spectrum specific of the radiator is formed. Further, in accordance with the laws of physics, it is characteristic of radiation that, when the temperature of the radiating piece rises, the transfer of radiation heat to the target material is increased in proportion to the difference between the fourth powers of the temperatures of the pieces.

However, the temperature of the radiator does not alone determine how much radiation can be absorbed into the material to be dried. The temperature, moisture, thickness, material, surface roughness, and brightness of the piece to be dried determine an absorption coefficient, which indicates what a proportion of the radiation arriving on the face of the piece to be dried is absorbed into the material. However, as a rule, the absorption coefficient is a function of the wavelength, so that in a short-wave range the absorption coefficient of a thin material is inferior to that in a medium-wave or long-wave range.

IR-radiation sources operating in the short-wave infrared range are considered radiators which emit a radiation whose wavelength of maximum intensity of radiation is in the wavelength range of 0.76 . . . 2.00 $\mu$m. IR-radiation sources operating in the medium-wave infrared range are considered radiators which emit a radiation whose wavelength of maximum intensity is in the wavelength range of 2.00 . . . 4.00 $\mu$m.

The correspondence with temperature is obtained by means of Wien's displacement law from the formula $$\lambda_{maximum} \times T = 2.8978 \cdot 10^{-3} (\text{mK})$$

The temperature range of a short-wave radiator is obtained as 3540° C. . . . 1176° C., and that of a medium-wave radiator as 1176° C. . . . 450° C.

The IR-dryers operating in the short-wave range are currently almost exclusively electrically operated. In them, usually a tungsten filament placed in a quartz tube is made to glow by means of electric current. The maximum emitter temperature of the glowing filament is usually about 2200° C., in which case the wavelength corresponding to the maximum intensity of radiation is about 1.2 μm.

In the prior-art short-wave infrared radiators, the lamps are, as a rule, arranged in heating modules of 3 . . . 12 lamps. The modules are attached side by side, and a drying zone extending across the web is obtained. The lamps are usually spaced so that the power density of the dryer per unit of area varies in a range of 100 . . . 450 kW per sq m.

The dryers operating in the medium-wave IR range are either electrically operated or gas-operated. In electric devices, filaments are made to glow by means of electric current either in a quartz tube or behind a ceramic tile or a tile made of quartz. In the former case, the spiral filament operates directly as the emitter, whereas in the latter case the heat is transferred first into the tile, after which the tile operates as the emitter. The tile may also be partly penetrable by radiation. In gas-operated systems, a usually ceramic radiator is made to glow by means of a flame, which radiator starts glowing and thus operates as the emitter. Radiation is partly also emitted directly from the flame. As was stated above, the wavelength of maximum intensity of medium-wave infrared radiators is 2.00 . . . 3.00 μm, the corresponding temperature of the radiator being, as was stated above, in the range of 1176° C. . . . 690° C. With medium-wave infrared radiators, the maximum power density varies, depending on the method and the temperature, substantially in a range of 40 . . . 100 kW per sq m.

Adverse aspects of short-wave infrared radiators include-poor radiation efficiency in the shorter wavelength range of the radiator influencing the overall efficiency, expensive electric control system, high cost for electricity and ventilation systems.

Adverse aspects of medium-wave infrared radiators include low power density per unit area when quick drying is aimed at, poor adjustability, slow heating and cooling, relatively high cost of electrical system and electricity in the case of electric infrared radiators. For gas operated systems the high cost for the gas feed system and the risk of explosion from handling of explosive gases can be mentioned.

The difficulties to use the cooling exhaust air or the exhaust gases for an efficient improvement of the drying process is common for both gas- and electrical medium wave dryers.

Thus, it can be considered that a major drawback of the prior art infrared heaters, ie. IR-dryers, consisting of short wave infrared radiators is poor efficiency because of the low absorption coefficient of the material to be dried in the shorter wave length range of the radiator.

When the IR-dryer consists of medium wave infrared radiators, a particular drawback can be considered to be the low power density and still the need for a relatively expensive electrical and ventilation system, poor controllability because of the slow heating and cooling of the medium-wave radiators and the difficulties to efficiently use the exhaust air or gases in the drying process.

In the EP Patent 288,524, a method is described for drying a moving web material.

In the method, infrared radiation is directed at the material to be dried, and the moving web material is passed through the radiation zone of the infrared radiator while the web material to be dried absorbs radiation into itself. In the method, the radiation produced by at least one first infrared radiator and the radiation produced by at least one second infrared radiator are directed at the moving web material to be dried, said radiators being fitted in the vicinity of one another. In this connection, the wavelength of the maximum intensity of the radiation of the first infrared radiator is shorter than the wavelength of the maximum intensity of the radiation of the second infrared radiator, in which case, in the drying process, the spectrum of the overall radiation is optimal in view of the absorption spectrum of the material to be dried. The maximum intensity of the radiation of the first infrared radiator occurs in the wavelength range of the radiation 0.76 $\mu m < \lambda_{maximum} < 2.00$ μm, and the maximum intensity of the radiation of the second radiator is in the wavelength range 2.00 $\mu m < \lambda_{maximum} < 4.00$ μm. The radiators can be fitted at the same side of the moving web material, or they can be fitted so that the first radiator is placed at one side of the web material and the second radiator at the opposite side.

By means of the method and the device in accordance with the EP Patent 288,524, a spectrum is obtained that is favourable in view of the drying. Then, an efficiency of radiation is achieved that is at least about 5% better than with the prior-art solutions of equipment.

From the prior art, it is known to provide the second radiator, placed at the opposite side of the web material to be dried, with a surface layer which in the short wave 0,5–2,0 μm spectra mainly reflects but partly also absorbs the radiation of the first infrared radiator that passes through the material web so that the temperature of the second infrared radiator rises to several hundreds of Celsius degrees. When a typical white ceramic material is used as the surface material, the temperature may rise to a value of an order of 500 . . . 700° C. for low grammage webs for example paper webs with grammages less than 110 g/m$^2$. A temperature of 500 . . . 700° C. is not yet sufficient as the surface temperature of the second infrared radiator, while its power density is a function of its temperature level in Kelvin degree in fourth power, but additional electric energy can be fed into the surface layer of the second infrared radiator according to EP Patent 288,524, whereby the surface temperature can be raised further to a temperature of 800 . . . 1050° C.

Thus, the backup radiator described above is a device that receives the heat radiation passing through the web and uses this heat for heating the surface layer of the device. The backup radiator is a medium-wave radiator. The backup radiator is used together with a short-wave infrared radiator. Together, these two devices produce a good drying result and efficiency.

OBJECTS AND SUMMARY OF THE INVENTION

The object of the present invention is to provide an improvement over the method and the device described in the EP Patent 288,524 for drying a moving web material. A specific object of the present invention is to provide a method and a device wherein it is possible to avoid the supply of additional electric energy to the surface layer of the second radiator.

The objectives of the invention are achieved by means of a method which is characterized in that (a) as the first infrared radiator, a radiator is used whose power density is 450 . . . 700 kW per sq m and whose emitter temperature is 2000 . . . 2800° C., (b) as the web material to be dried, a web is used whose transmissivity is substantially higher than, or equal to, 0.18 for short wave infrared radiation 0.5–2.0 μm, (c) as the second infrared radiator, a radiator is used whose surface layer is made of such a metal, metal alloy or ceramic material whose emissivity is substantially higher than, or equal to, 0.6, within the total wavelength range of 0.5–2.0 μm.

in which case, of the power density of the first infrared radiator, such a percentage proportion passes through the web as is sufficient to be capable of heating the surface layer of the second infrared radiator to a temperature of substantially at least 800° C.

On the other hand, the device in accordance with the invention is characterized in that the power density of the first infrared radiator is 450 . . . 700 kW per sq m and the temperature 2000 . . . 2800° C., and the surface layer of the second infrared radiator is made of a metal, metal alloy or ceramic material whose emissivity is substantially higher than 0.6 within the total wavelength range of 0.5–2.0 $\mu$m.

The device and the method in accordance with the present invention are particularly well suitable for thin web grades, which have a transmissivity $\tau$ equal or higher than 0.18 for short wave radiation for example corresponding to grammages equal or less than 110 g/m$^2$ for ordinary paper webs. As the first radiator, a radiator is used whose power density is 450 . . . 700 kW per sq m and whose temperature is 2000 . . . 2800° C. As the second radiator, a radiator is used whose surface layer is made of a metal, metal alloy or ceramic material whose emissivity is substantially higher than 0.6 within the total wavelength range of 0.5–2.0 $\mu$m. In such a case, of the power density of the first radiator, such a percentage proportion of the energy passes through the web as is sufficient to heat the surface layer of the second radiator to a temperature of substantially at least 800° C.

In a preferred embodiment of the invention, the power density of the first radiator is chosen at a value of 530 . . . 650 kW per sq m, and the temperature with the maximum power density at the value 2100 . . . 2600° C., and the emissivity of the surface layer of the second radiator is chosen at a value of 0,65–0,9 within the total wavelength range of 0.5–2.0 $\mu$m.

In a preferred embodiment of the invention, the surface layer is formed of a metal alloy which contains 10 . . . 26%-wt. (per cent by weight) of chromium, 0 . . . 84%-wt. of iron, and 0 . . . 81%-wt. of nickel and 0–25%-wt. of aluminium. A metal alloy is particularly favourable which contains chromium, >20%-wt. of iron and alternatively nickel or aluminium or a metal alloy of chromium and nickel.

In a preferred embodiment of the invention, ceramic material has been chosen from the group of carbides, nitrides and suicides.

In an another preferred embodiment of the invention, ceramic material is a ceramic base, preferably an aluminium oxide, zirconium oxide, glass ceramic or quartz material, coated with a carbide, nitride, silicide, a metal or a metal alloy.

BRIEF DESCRIPTION OF THE DRAWINGS

The invention will be described in detail with reference to some preferred embodiments of the invention illustrated in the figures in the accompanying drawings, the invention being, however, not supposed to be confined to said embodiments alone.

FIG. 9 is an enlarged view of a part A of FIG. 8.

FIG. 10 is a perspective view of an alternative embodiment of a radiator tray which is a part of the second radiator in FIG. 2.

FIG. 11 is a planar view from above of the radiator tray shown in FIG. 10.

FIG. 12 is a view from above in FIG. 11.

FIG. 13 is a view from the left in FIG. 11.

FIG. 14 is a view corresponding to FIG. 13, but with the flanged sheet in the left edge dismounted.

DETAILED DESCRIPTION OF THE PREFERRED EMBODIMENTS

Figure 1:
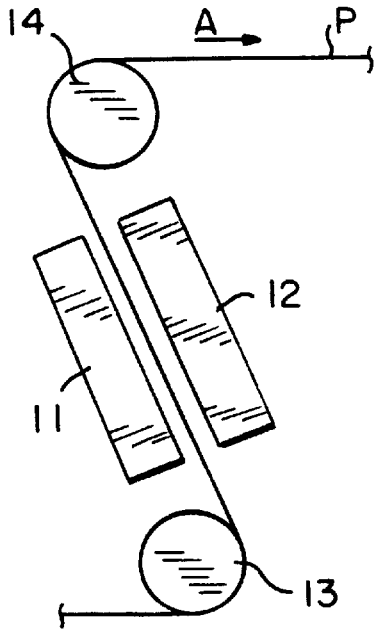
FIG. 1 PRIOR ART
FIG. 1 is a schematic side view illustrating a prior-art method for drying a web material.

In the prior-art solution shown in FIG. 1, the web material to be dried is denoted with the letter P. The web material passes over the rolls 13 and 14, and the running direction of the web material P is denoted with the arrow A. The first infrared radiator 11 is placed at one side of the web P, and similarly the second infrared radiator 12 is placed at the opposite side of the web P. The infrared radiator 11 and the infrared radiator 12, respectively, may consist of one or several separate radiators. When solutions known from the prior art are used as the surface layer in the second radiator, the radiation of the first infrared radiator 11 that passes through the web P can heat the surface layer of the second radiator 12, at the maximum, to a temperature of about 500 . . . 700° C.

Figure 2:
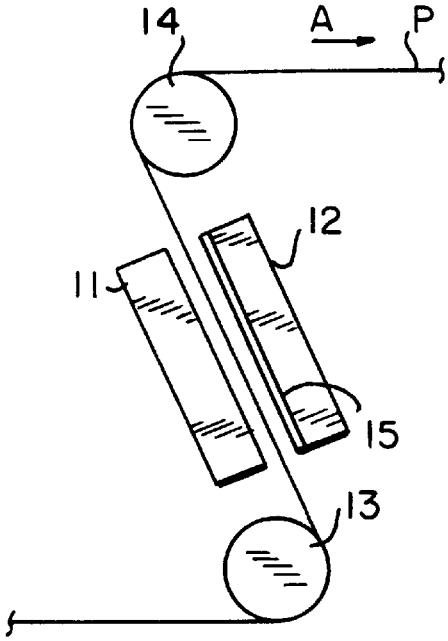
FIG. 2 is a schematic side view illustrating the basic principle of the method in accordance with the present invention.

In FIG. 2, the surface layer in accordance with the present invention is denoted with the reference numeral 15. The power density of the first infrared radiator 11 is chosen as 450 . . . 700 kW per sq m, and the temperature is chosen as 2000 . . . 2800° C. As the surface layer 15 of the second radiator 12, a metal, metal alloy or a ceramic material is used, whose emissivity is substantially higher than, or equal to, 0.6 within the total wavelength range of 0.5–2.0 $\mu$m. When a web material with equal or higher transmissivity $\tau$ than 0.18 for short wave infrared radiation which for example with ordinary paper webs correspond to grammages substantially equal or less than 110 g/m$^2$ is used, such a percentage proportion of the intensity of the first radiator 11 passes through the web P as is sufficient to heat the surface layer of the second radiator 12 substantially at least to a temperature of 800° C.

Advantageously, the surface layer 15 contains 10 . . . 26%-wt. of chromium, 0 . . . 84%-wt. of iron, and 0 . . . 81%-wt. of nickel, 0–25%-wt of aluminium. In a preferred embodiment, the surface layer 15 contains a metal alloy with chromium, >20%-wt. of iron and alternatively nickel or aluminium or a metal alloy of nickel and chromium.

The second radiator 12 in FIG. 2 have a frame on which box-shaped radiator trays according to FIGS. 3–9 are mounted.

The radiator tray according to FIGS. 3–9 is as a whole marked with 20. It comprises a with heat insulation 22 of ceramic fibres filled radiator sheet box 23 together with radiator surface material 24, in one or several parts, building up the surface layer 15 in FIG. 2.

Figure 3:
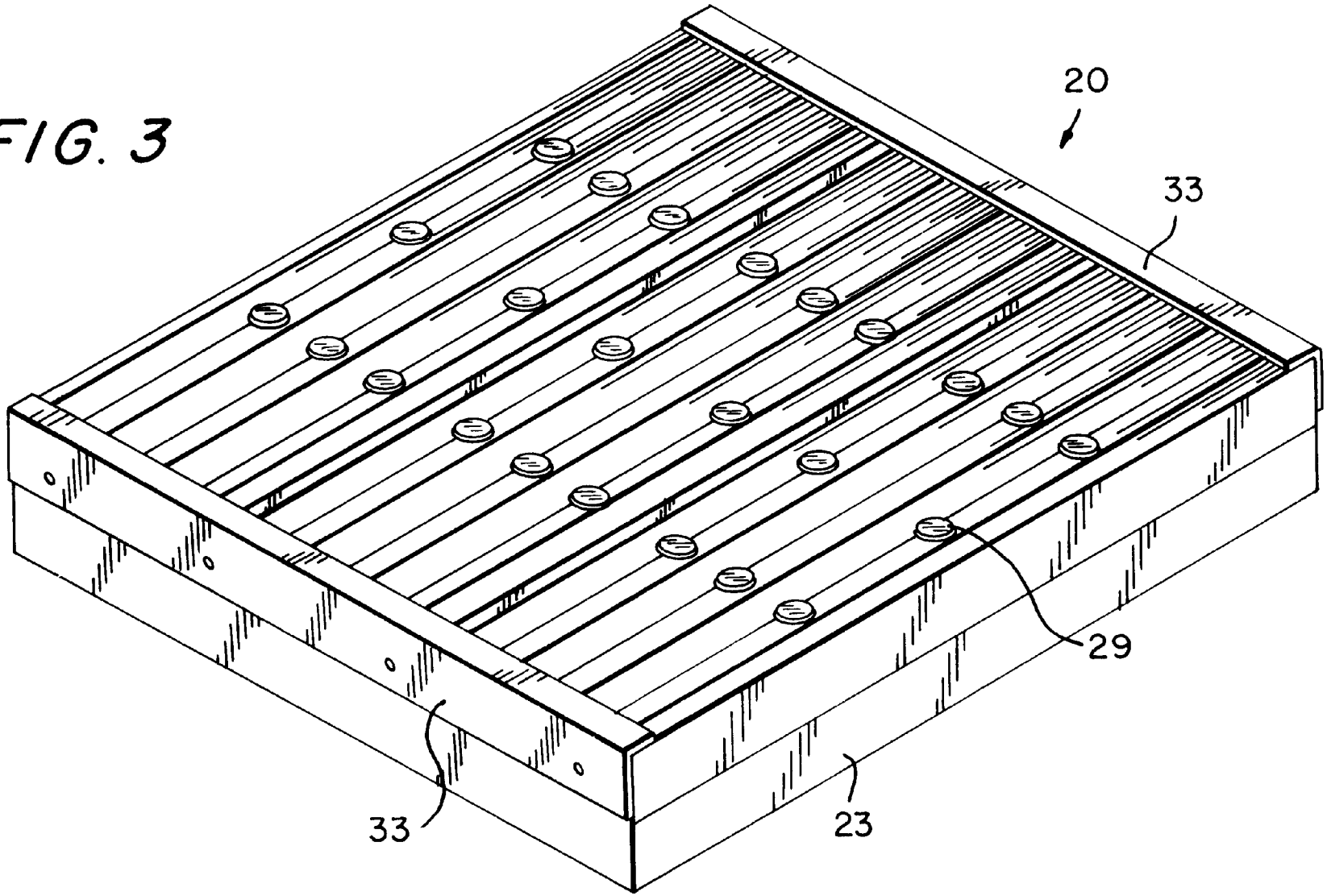
FIG. 3 is a perspective view of a first embodiment of a radiator tray which is a part of the second radiator in FIG. 2.
Figure 4:
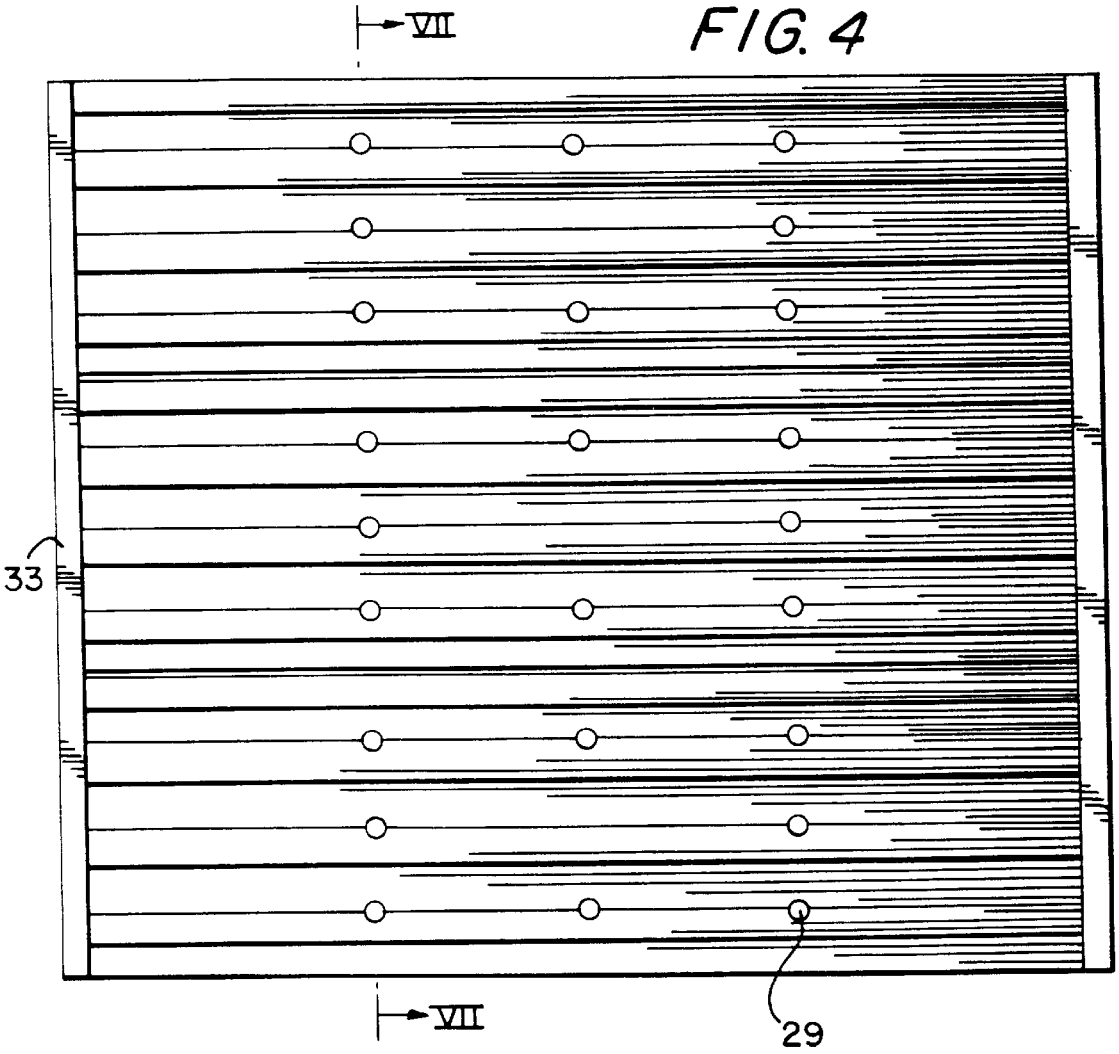
FIG. 4 is a planar view from above of the radiator tray shown in FIG. 3.
Figure 5:
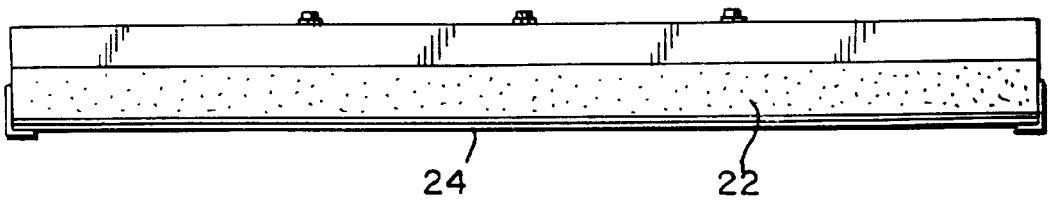
FIG. 5 is a view from above in FIG. 4.
Figure 6:
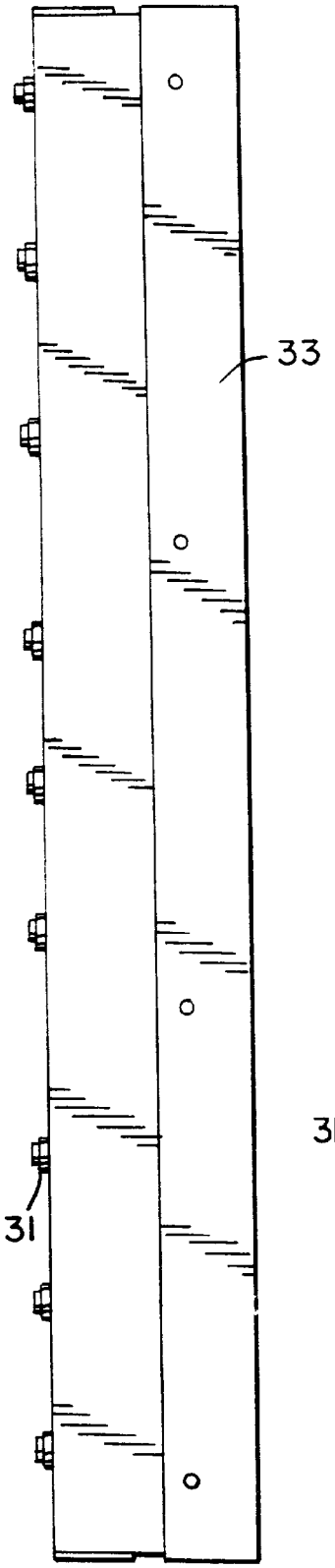
FIG. 6 is a view from the left in FIG. 4.
Figure 7:
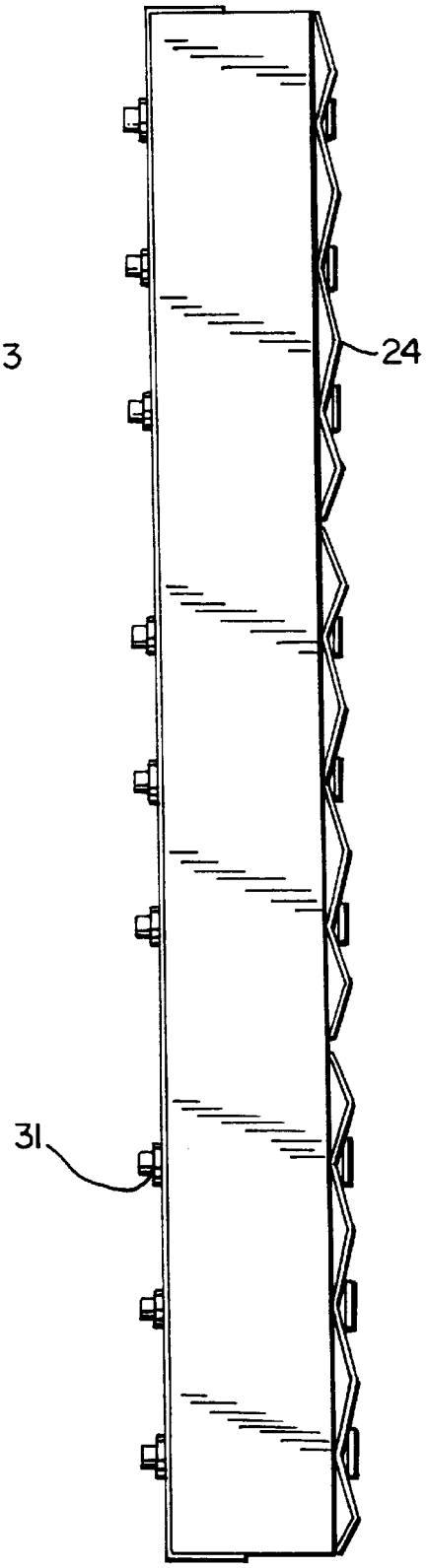
FIG. 7 is a view corresponding to FIG. 6, but with the flanged sheet in the left edge dismounted.
Figure 8:
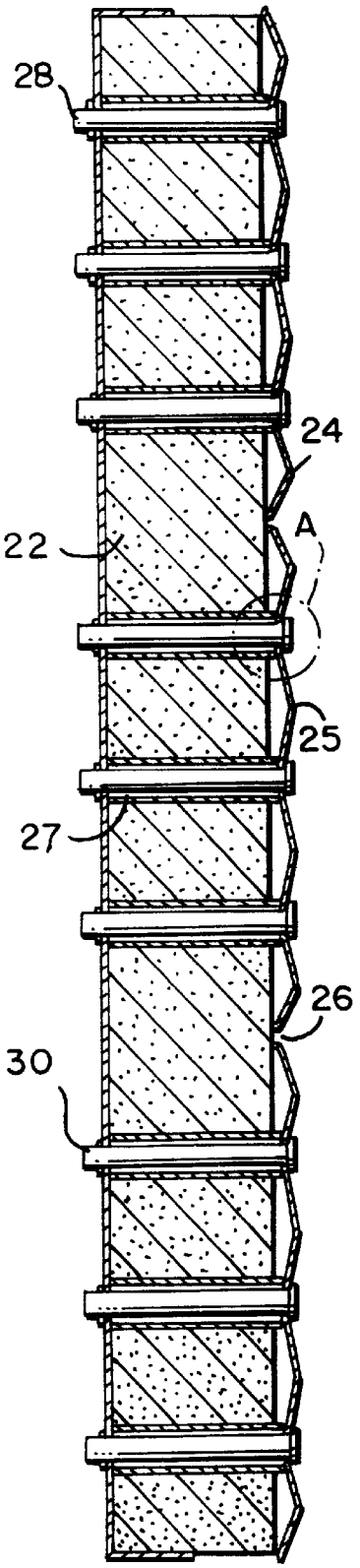
FIG. 8 is a partially sectioned view according to the line VIII—VIII in FIG. 4.

A radiator surface material or part 24 according to the invention is shown from a side view in FIG. 8. As can be seen from FIG. 8 and FIG. 3 is this part bended showing longitudinal waves with tops 25 and grooves 26, in which row-vise are arranged holes 27 for mounting of bolts 28 with a head 29 and free ends 30 with lock pins 31.

As can be seen from FIG. 9 is the outmost situtated longitudinal row of holes situated in an eccentric manner to press the outmost free wave effectively down. In this way the design will prevent the mentioned outmost waves from bending upwards forming an obstacle for the passing web or other parts.

According to the design the bolts 28 can be surrounded by distance pipes 32 to secure a defined thickness of the total radiator tray 20.

The radiator tray frame can be comprised by sections in which case two on the opposite side situated flanged sheets 33 are mounted to lay upon the radiator surface material parts and lock them up in the edges.

An alternative embodiment of a radiator tray 20*a* according to the invention is shown in FIGS. 10–14.

The second radiator 12 in FIG. 2 have a frame on which box-shaped radiator trays according to FIGS. 10–14 are mounted.

The radiator tray according to FIGS. 10–14 is as a whole marked with 20*a*. It comprises a with heat insulation 22 of ceramic fibres filled radiator sheet box 23 together with radiator surface matterial 24*a* in one or several parts building up the surface layer 15 in FIG. 2.

The alternative embodiment can preferably be used if the radiator surface material 24*a* of ceramic material, metal or an metal alloy according to the invention have such a mechanical stability over 800° C. that the flanged sheets 33 on both sides are capable to keep the radiator surface material in a fixed position over its total surface.

Above, just the solution of principle of the invention has been described, and it is obvious to a person skilled in the art that numerous modifications can be made to said solution within the scope of the inventive idea defined in the accompanying patent claims.

We claim:

1. A method for drying a moving web having a transmissivity substantially equal to or higher than about 0.18 for short wave infrared radiation having a wavelength from about 0.5 $\mu$m to about 2.0 $\mu$m, comprising the steps of:

arranging a first infrared radiator on a first side of the web, said first infrared radiator having a power density from about 450 kW per sq.m to about 700 kW per sq.m and an emitter temperature from about 2000° C. to about 2800° C., arranging a second infrared radiator on a second side of the web at least partially opposite to said first infrared radiator and proximate to said first infrared radiator, said second infrared radiator including a surface layer made of a metal, metal alloy or ceramic material whose emissivity is substantially equal to or higher than about 0.6 within the total wavelength range of from about 0.5 $\mu$m to about 2.0 $\mu$m, directing infrared radiation from said first and second infrared radiators at the web by passing the web between said first and second infrared radiators such that the web absorbs radiation and is dried, operating said first infrared radiator and said second infrared radiator such that the wavelength of the maximum intensity of the radiation generated by said first infrared radiator is shorter than the wavelength of the maximum intensity of the radiation generated by said second infrared radiator, and selecting the power density and emitter temperature of said first infrared radiator such that a portion of the power density of said first infrared radiator passes through the web and is effective to heat said surface layer of said second infrared radiator to a temperature of at least about 800° C.

2. The method of claim 1, further comprising the step of:

utilizing a paper web having a grammage substantially equal to or less than about 110 grams per sq.m as the web.

3. The method of claim 1, wherein the power density of said first infrared radiator is selected in the range of from about 530 kW per sq m to about 650 kW per sq m and the emitter temperature of said first infrared radiator is selected in the range of from about 2100° C. to about 2600° C.

4. The method of claim 1, further comprising the step of:

selecting the metal, metal alloy or ceramic material of said second infrared radiator such that it has an emissivity from about 0.65 to about 0.9 within the total wavelength range of about 0.5 $\mu$m to about 2.0 $\mu$m.

5. The method of claim 1, wherein said surface layer of said second infrared radiator is made of a metal alloy containing chromium, aluminum, nickel and iron.

6. The method of claim 1, wherein said surface layer of said second infrared radiator contains 10%–26% of chromium by weight, 0–84% of iron by weight, 0–81% of nickel by weight, and 0–25% of aluminum by weight.

7. The method of claim 1, wherein said surface layer of said second infrared radiator is made of a metal alloy including chromium, more than 20% of iron by weight, and nickel, aluminum or a metal alloy of chromium and nickel.

8. The method of claim 1, wherein said surface layer of said second infrared radiator is made of a ceramic material selected from a group consisting of carbides, nitrides and silicates.

9. The method of claim 1, wherein said surface layer of said second infrared radiator is made of a ceramic material comprising a ceramic base selected from a group consisting of aluminum oxide, zirconium oxide, glass ceramic and quartz material, and a coating selected from a group consisting of a carbide, nitride, silicate, a metal and a metal alloy.

10. A device for drying a moving web, comprising a first infrared radiator arranged on a first side of the web and having a power density from about 450 kW per sq.m to about 700 kW per sq.m and an emitter temperature from about 2000° C. to about 2800° C., and a second infrared radiator arranged on a second side of the web at least partially opposite to said first infrared radiator and proximate to said first infrared radiator, said first infrared radiator and said second infrared radiator being structured and arranged such that the wavelength of the maximum intensity of the radiation generated by said first infrared radiator is shorter than the wavelength of the maximum intensity of the radiation generated by said second infrared radiator, said second infrared radiator comprising a surface layer made of a metal, metal alloy or ceramic material whose emissivity is substantially equal to or higher than about 0.6 within the total wavelength range of from about 0.5 $\mu$m to about 2.0 $\mu$m.

11. The device of claim 10, wherein the power density of said first infrared radiator is in the range of from about 530 kW per sq m to about 650 kW per sq m and the emitter temperature of said first infrared radiator is in the range of from about 2100° C. to about 2600° C.

12. The device of claim 10, wherein said surface layer of said second infrared radiator has an emissivity from about 0.65 to about 0.9 within the total wavelength range of about 0.5 $\mu$m to about 2.0 $\mu$m.

13. The device of claim 10, wherein said surface layer of said second infrared radiator is made of a metal alloy containing chromium, aluminum, nickel and iron.

14. The device of claim 10, wherein said surface layer of said second infrared radiator contains 10%–26% of chromium by weight, 0–84% of iron by weight, 0–81% of nickel by weight, and 0–25% of aluminum by weight.

15. The device of claim 10, wherein said surface layer of said second infrared radiator is made of a metal alloy including chromium, more than 20% of iron by weight, and nickel, aluminum or a metal alloy of chromium and nickel.

16. The device of claim 10, wherein said surface layer of said second infrared radiator is made of a ceramic material selected from a group consisting of carbides, nitrides and silicates.

17. The device of claim 10, wherein said surface layer of said second infrared radiator is made of a ceramic material comprising a ceramic base selected from a group consisting of aluminum oxide, zirconium oxide, glass ceramic and quartz material, and a coating selected from a group consisting of a carbide, nitride, silicate, a metal and a metal alloy.

18. The device of claim 10, wherein said surface layer of said second infrared radiator includes ridges and grooves to provide said surface layer with a wavy contour.

19. The device of claim 10, wherein said second infrared radiator comprises a box having first and second sides, said surface layer having apertures and being arranged on said first side of said box, a layer of heat insulation arranged in said box, said layer of heat insulation having holes therethrough, and bolts arranged to extend through said apertures in said surface layer, said holes in said heat insulation and holes in said second side of said box for securely retaining said surface layer in connection with said box.

20. The device of claim 19, wherein said apertures in said surface layer are arranged in longitudinal rows such that outermost longitudinal rows of said holes are situated in an eccentric manner.

* * * * *